US006246303B1

(12) United States Patent
Endo

(10) Patent No.: US 6,246,303 B1
(45) **Date of Patent: *Jun. 12, 2001**

(54) DIELECTRIC FILTER

(75) Inventor: Kenji Endo, Abiko (JP)

(73) Assignee: TDK Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/234,111

(22) Filed: Jan. 19, 1999

Related U.S. Application Data

(63) Continuation of application No. 08/816,734, filed on Mar. 14, 1997, now Pat. No. 5,999,070.

(30) Foreign Application Priority Data

Mar. 15, 1996 (JP) ..... 9-59656

(51) Int. Cl.[7] ..... H01P 1/205
(52) U.S. Cl. ..... 333/206; 333/207
(58) Field of Search ..... 333/202, 206, 333/207, 222, 223

(56) References Cited

U.S. PATENT DOCUMENTS 5,999,070 * 12/1999 Endo ..... 333/206

* cited by examiner

*Primary Examiner*—Benny Lee
*Assistant Examiner*—Stephen E. Jones
(74) *Attorney, Agent, or Firm*—Oblon, Spivak, McClelland, Maier & Neustadt, P.C.

(57) ABSTRACT

A block type dielectric filter including a dielectric block and a plurality of through holes wherein a resonance frequency at individual resonating portions can be set at a specific value even when the dielectric filter is miniaturized. The resonance frequencies can be varied at the individual resonating portions simply by creating a slight change in a coupling factor. The plurality of through holes are provided extending from one surface of the dielectric block toward an opposite surface. Surfaces, except for an open end surface, of said dielectric block are clad with a conductive material layer and a groove is provided on the open end surface between a set of adjacent through holes. The groove is provided offset toward a through hole by an offset quantity.

31 Claims, 6 Drawing Sheets

DIELECTRIC FILTER

This application is a Continuation of application Ser. No. 08/816,734 Filed on Mar. 14, 1997, now U.S. Pat. No. 5,999,070.

BACKGROUND OF THE INVENTION

1. Field of the Invention

The present invention relates to a block type dielectric filter.

2. Discussion of Background

A block type dielectric filter constituted by having a plurality of through holes that extend from one surface of a dielectric block toward the opposite surface with the surfaces, except for the one surface, being clad with a conductive material layer, is used in mobile communication devices such as car phones and cordless phones or in satellite communication. The one surface that is not clad with a conductive material layer is normally referred to as an open end surface.

Means for adjusting the resonance frequencies at the resonating portions of such a block type dielectric filter in the prior art include a method whereby the lengths of the through holes are varied, a method in which an electrode pattern is formed at the open end surface to achieve a specific capacitance between the resonating portions and the ground at a side surface, a method whereby an indented portion is provided to encompass the through holes or at an area that comes in contact with the through holes at the open end surface with this indented portion also being clad with a conductive material layer so that a specific level of capacitance is achieved between the indented portion and the ground at the side surface and the like (for instance, see Japanese Unexamined Patent Publication No. 226909/1993).

However, with the aggressive miniaturization going on at present in mobile communication devices, which constitute a vital application for this type of dielectric filter, continued miniaturization is also required of the block type dielectric filters that constitute a component thereof and it is becoming physically difficult to further vary the size of the dielectric block, to add minute electrode patterns or to form minute indented portions.

As a means for adjusting the coupling factor, which is another vital factor that affects the characteristics of the block type dielectric filter, a method featuring a groove provided at an approximately central area between adjacent through holes at the open end surface in a direction running perpendicular to the direction in which the through holes are arranged, in which the depth, the width and the like of the groove are varied for the purpose of adjustment is known (for instance, see Japanese unexamined Patent Publication No. 139901/1992).

However, when this method is employed, since the resonance frequency changes along with the coupling factor, it is not possible to adjust the resonance frequency independently of the coupling factor. Furthermore, in a standard resonating portion ($\lambda/4$) with this method, the length of the resonating portion can be reduced only by a quantity that corresponds to the dielectric constant.

SUMMARY OF THE INVENTION

It is an object of the present invention to provide a block type dielectric filter with which the resonance frequency at each resonating portion can be set at a specific value easily even when it is miniaturized.

It is a further object of the present invention to provide a block type dielectric filter with which the resonance frequency at each resonating portion can be varied and adjusted greatly simply by creating a slight change in the coupling factor.

It is a still further object of the present invention to provide a block type dielectric filter that can be miniaturized to a degree exceeding that corresponding to the dielectric constant of the dielectric block.

In order to achieve the objects described above, in the dielectric filter according to the present invention, there is provided a plurality of through holes extending from one surface of a dielectric block toward the opposite surface with the surfaces, except for the one surface, being clad with a conductive material layer, and with a groove on the one surface between at least one set of adjacent through holes, the groove is provided either entirely or partially offset toward either one of the through holes in the set.

According to the present invention, the groove is provided entirely or partially offset toward either one of the through holes in the set. In such a structure, the resonance frequency of the resonating portion constituted of the through hole that is closer to the groove is adjusted mainly in correspondence to the offset quantity of the groove. In this case, the coupling factor between the resonating portions only changes a little. This means that it becomes possible to greatly vary the setting for the resonance frequency at each resonating portion without essentially changing the coupling factor.

When the groove is provided offset toward either one of the through holes of the set, the resonance frequency can be even more greatly varied by bending or curving the groove. This achieves miniaturization by a degree exceeding that corresponding to the dielectric constant of the dielectric block.

The setting of the resonance frequency in the present invention is achieved by selecting a specific position, shape or the like for the groove formed at the dielectric block, and it is not necessary to change the size of the dielectric block or to add minute electrical patterns. This means that even a miniaturized dielectric filter can be achieved with ease and also that the resonance frequency at each resonating portion can be easily set at a specific value.

BRIEF DESCRIPTION OF THE DRAWINGS

More specific features and advantages of the present invention are explained in further detail in reference to the drawings, wherein.

DETAILED DESCRIPTION OF THE PREFERRED EMBODIMENTS

Figure 1:
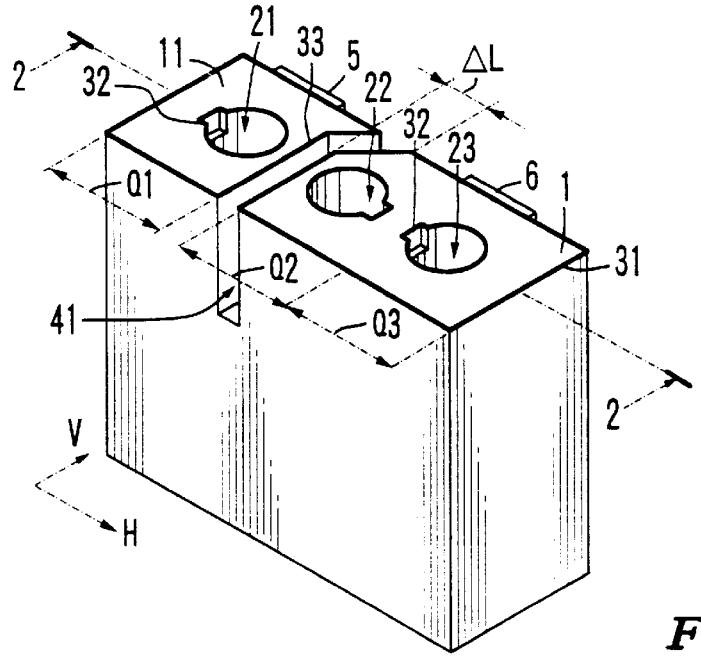
FIG. 1 is a perspective view of the block type dielectric filter according to the present invention.
Figure 2:
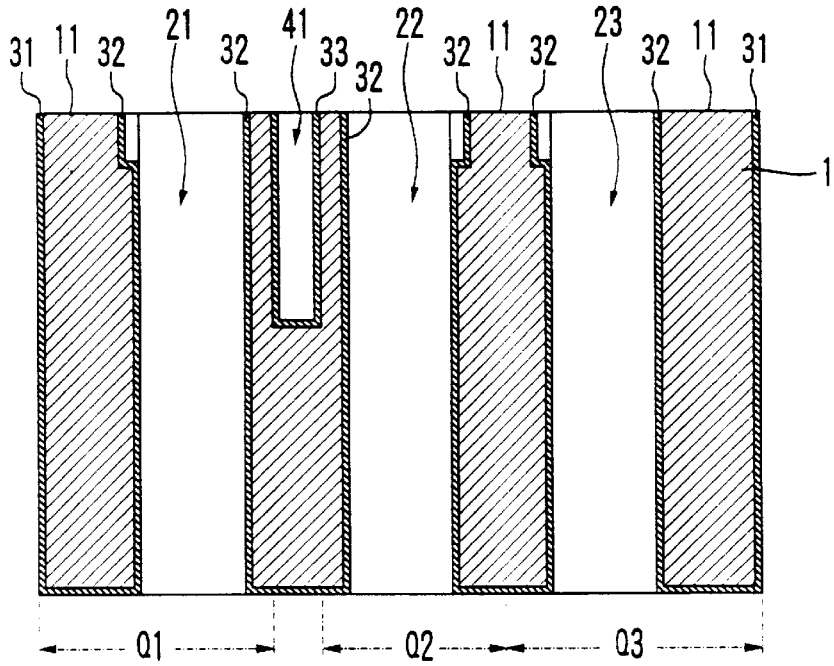
FIG. 2 is a cross section of FIG. 1 through line 2—2.

In reference to FIGS. 1 and 2, the dielectric filter according to the present invention is provided with a plurality of through holes 21, 22 and 23 which extend from one surface (hereafter referred to as the open end surface) 11 of a dielectric block 1 toward the opposite surface, with the surfaces, except for the open end surface 11, being clad with a conductive material layer 31. It is also provided with a groove 41 formed on the open end surface 11 between a set of adjacent through holes 21 and 22.

On the inside surfaces of the through holes 21, 22 and 23, a conductive material layer 32, which constitutes a central conductor, is formed and with this, resonating portions Q1, Q2 and Q3 are formed at the through holes 21, 22 and 23 respectively. The conductive material layers 31 and 32 are constituted by using a material that is known for achieving this type of dielectric filter in the prior art and are formed as baked conductive films that are referred to as metallized film among persons skilled in the field.

Figure 3:
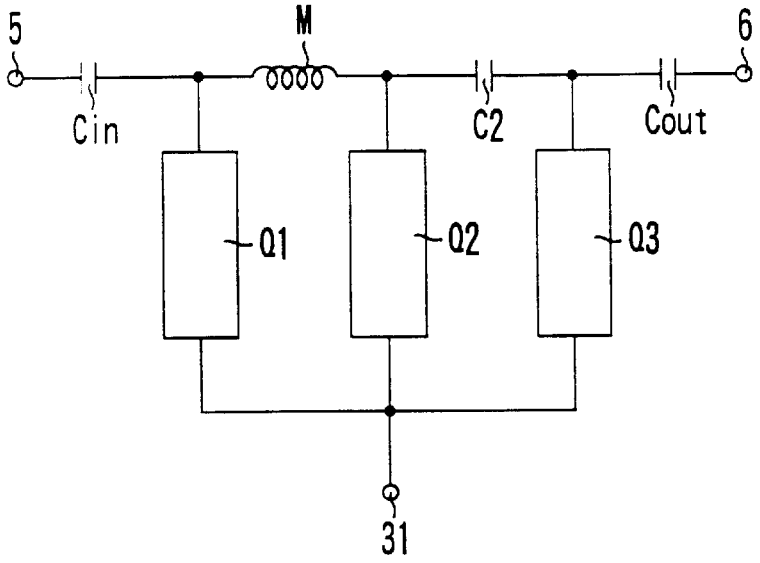
FIG. 3 is an electric circuit diagram of the dielectric filter shown in FIGS. 1 and 2.

In reference to FIG. 3, of the resonating portions Q1 to Q3, the resonating portions Q1 and Q2 are coupled via an inductive coupling M and the resonating portions Q2 and Q3 are coupled via a coupling capacity C2. The resonating portions Q1 and Q3 at the two sides are respectively connected to input/output electrodes 5 and 6 via an input capacity Cin an dan output capacity Cout. The conductive material layer 31 constitutes the ground.

The groove 41 is provided with an offset toward the through hole 22 of quantity ΔL (see FIG. 1). In the embodiment shown in the figure, the groove 41 is formed as a bent channel that is constituted of a perpendicular portion extending in a direction V running almost perpendicular to a direction H, which is the direction in which the through holes 21 to 23 are arranged, and an inclined portion which is inclined from the perpendicular portion toward the through hole 22 by the quantity ΔL.

In this structure, a resonance frequency f2 of the resonating portion Q2 constituted of the through hole 22 that is located closest to the groove 41 is set mainly in correspondence to the offset quantity ΔL of the groove 41. The direction in which the resonance frequency f2 changes is the direction in which the frequency becomes reduced. In such a case, the coupling factor between the resonating portions Q1 and Q2 only changes slightly. This means that the resonance frequency f2 of the resonating portion Q2 can be adjusted over a great range without essentially changing the coupling factor.

By achieving this offset of the groove toward the through hole 22 in the set of through holes 21 and 22 by bending or curving the groove 41, as shown in FIG. 1, the resonance frequency can be varied even more greatly. This allows miniaturization of the dielectric block 1 to a degree exceeding that corresponding to the dielectric constant.

The adjustment of the resonance frequency according to the present invention is executed by selecting a specific position, shape and the like for the groove 41 formed at the dielectric block 1. As a result, it is not necessary to vary the size of the dielectric block 1 or to add minute electrode patterns. This means that the resonance frequency at each of the individual resonating portions Q1 to Q3 can be set at a specific value with ease even when the filter is miniaturized.

In the embodiment, the surface of the groove 41 is clad with a conductive material layer 33. The conductive material layer 33 is continuous to the conductive material layers 31 and 32. In such a structure, a load capacity is formed between the groove 41 and the through hole 22 constituting the resonating portion Q2 an their electrical fields are coupled between the conductive material layer 33 and the conductive material layer 32 of the resonating portion Q2. Since the groove 41 is provided with an offset by the offset quantity ΔL toward the through hole 22, a greater load capacity can be formed, which, in turn, makes is possible to greatly reduce the resonance frequency f2.

It is to be noted that when the resonance frequencies of block type dielectric filters provided with two through holes were measured, the measurement for a block type dielectric filter formed in the conventional manner was 1860 MHz, whereas in a block type dielectric filter provided with a groove which is bent to encompass a through hole, the frequency of the resonating portion that is encompassed by the groove was reduced to 1842 MHz with the frequency at the other resonating portion increased to 1870 MHz.

Figure 4:
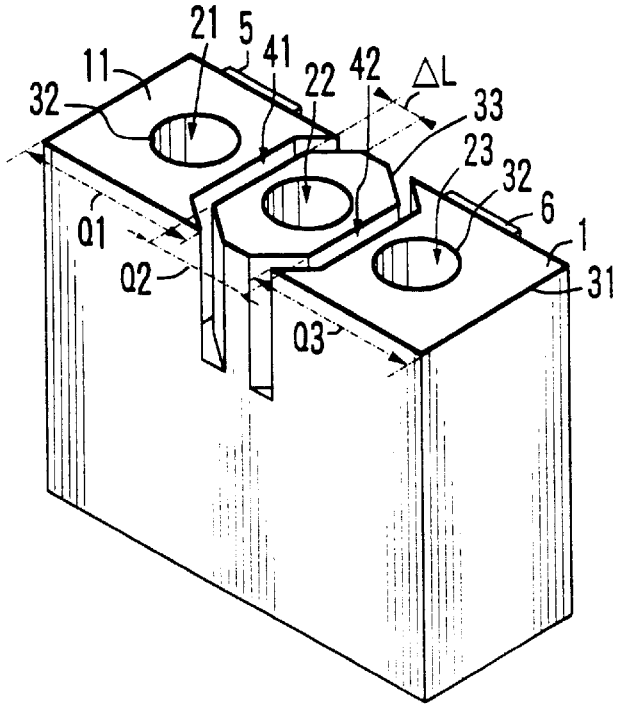
FIG. 4 is a perspective view showing another embodiment of the block type dielectric filter according to the present invention.

FIG. 4 is a perspective showing another embodiment of the dielectric filter according to the present invention. In this embodiment, grooves 41 and 42 are provided at the two sides of the through hole 22 to encompass the through hole 22 constituting the resonating portion Q2 at the center in a dielectric filter provided with three resonating portions Q1 to Q3. Since, under normal circumstances, the resonance frequency f2 at the resonating portion Q2 is lower than the resonating frequencies f1 and f3 of the resonating portions Q1 and Q3 at the two ends in a filter with three or more stages, the resonance frequency f2 at the resonating portion Q2 constituted of the through hole 22 is reduced by providing the grooves 41 and 42 to encompass the central through hole 22 without essentially changing the resonance frequencies f1 and f3 at the resonating portions Q1 and Q3 at the two ends, to achieve an overall adjustment of the frequency characteristics.

Figure 5:
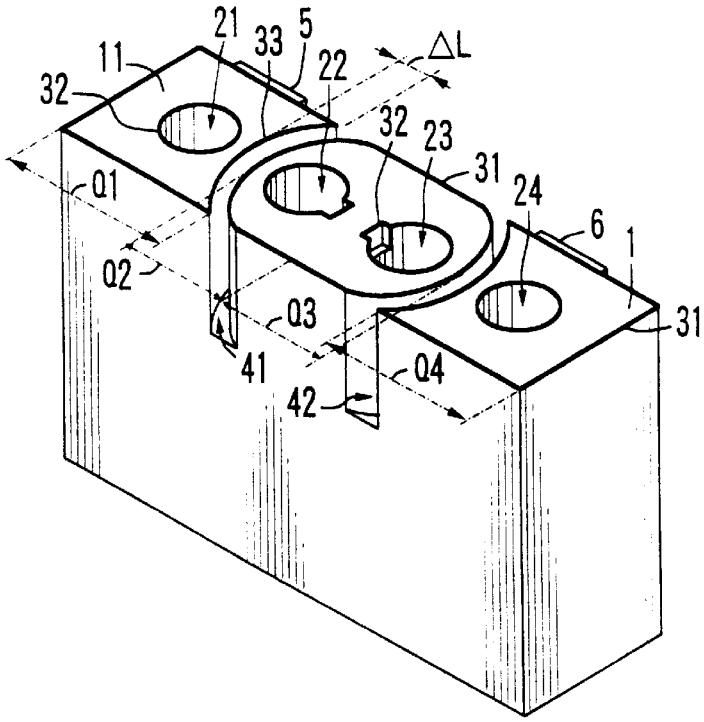
FIG. 5 is a perspective view showing yet another embodiment of the block type dielectric filter according to the present invention.

FIG. 5 is a perspective showing yet another embodiment of the dielectric filter according to the present invention. In this embodiment, arc-like grooves 41 and 42 are provided at the sides of the through holes 22 and 23 which are further away from each other to encompass the through holes 22 and 23 constituting the two central resonating portions Q2 and Q3 in a dielectric filter provided with four resonating portions Q1 to Q4. In this embodiment, the resonance frequencies f2 and f3 at the resonating portions Q2 and Q3 are reduced without essentially changing the resonance frequencies f1 and f4 at the resonating portions Q1 and Q4 at the two ends, making it possible to achieve an overall adjustment of the frequency characteristics.

Figure 6:
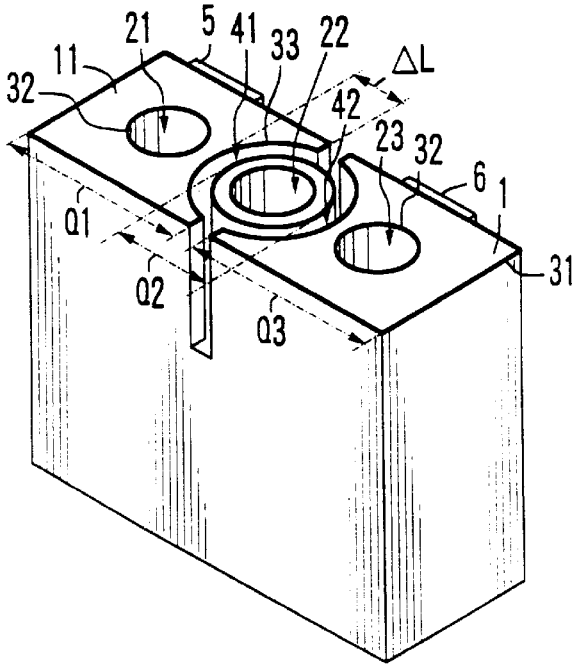
FIG. 6 is a perspective view showing yet another embodiment of the block type dielectric filter according to the present invention.

FIG. 6 is a perspective showing yet another embodiment of the dielectric filter according to the present invention. In this embodiment, semi-arc like grooves 41 and 42 are provided at the two sides of the through hole 22 to encompass the through hole 22 constituting the central resonating portion Q2 in an arc-like from in a dielectric filter provided with three resonating portions Q1 to Q3.

Figure 7:
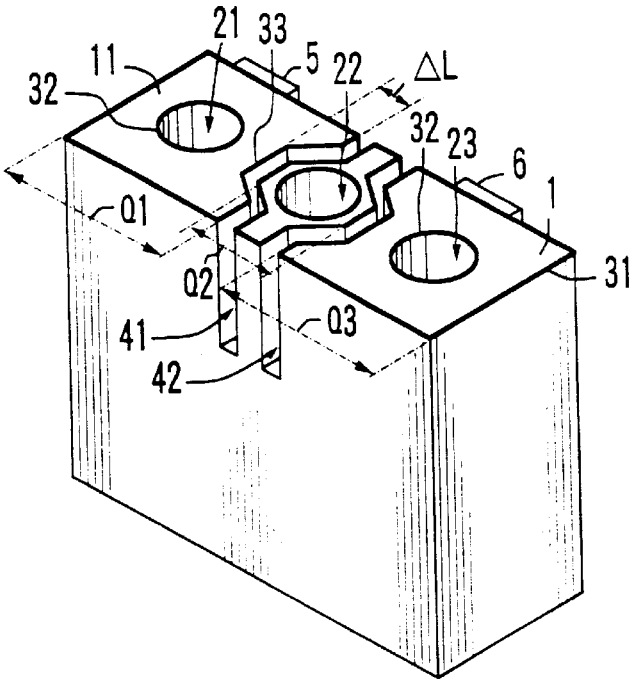
FIG. 7 is a perspective view showing yet another embodiment of the block type dielectric filter according to the present invention.

FIG. 7 is a perspective showing yet another embodiment of the dielectric filter according to the present invention. In this embodiment, two grooves 41 and 42 are provided in a crooked line form at the two sides of the through hole 22 to encompass the through hole 22 constituting the central resonating portion Q2 in a dielectric filter provided with three resonating portions Q1 to Q3. In this embodiment too, the resonance frequency f2 at the resonating portion Q1 constituted of the through hole 22 an be reduced without essentially changing the resonance frequencies f1 and f3 of the resonating portions Q1 and Q3 at the two ends.

Figure 8:
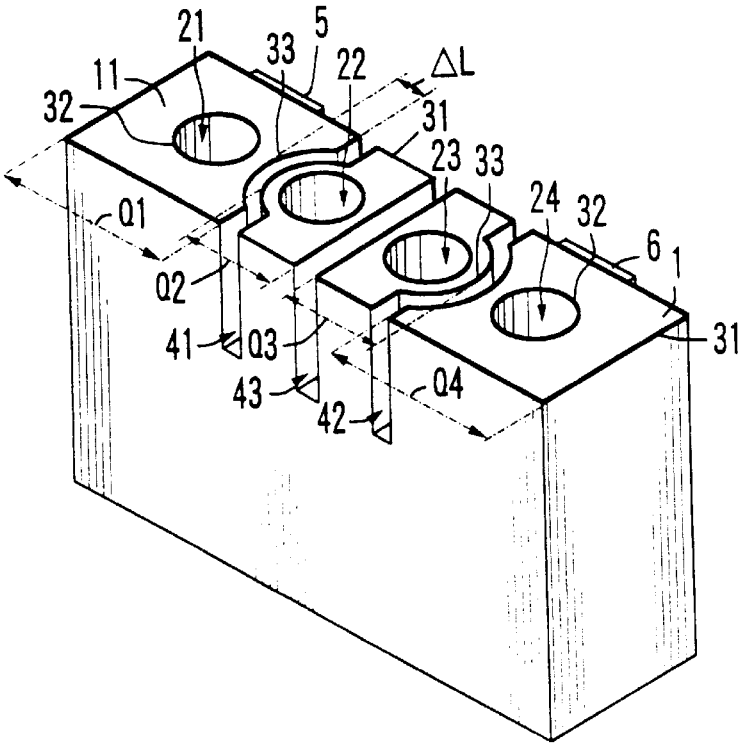
FIG. 8 is a perspective view showing yet another embodiment of the block type dielectric filter according to the present invention.

FIG. 8 is a perspective showing yet another embodiment of the dielectric filter according to the present invention. In this embodiment, arc-like grooves 41, 42 are provided at the sides of the through holes 22 and 23 that are further away from each other to encompass the through holes 22 and 23 that constitute the two central resonating portions Q2 and Q3 respectively in a dielectric filter provided with four resonating portions Q1 to Q4. In this embodiment, the resonance frequencies f2 and f3 at the resonating portions Q2 and Q3 are reduced without essentially changing the resonance frequencies f1 and f4 at resonating portions Q1 and Q4 at the two ends, achieving an overall adjustment of the frequency characteristics. Furthermore, another linear groove 43 is provided between the two central resonating portions Q2 and Q3. This groove 43 is provided to set the coupling quantity between the resonating portions Q2 and Q3 and is positioned approximately half way between the resonating portion Q2 and Q3.

Figure 9:
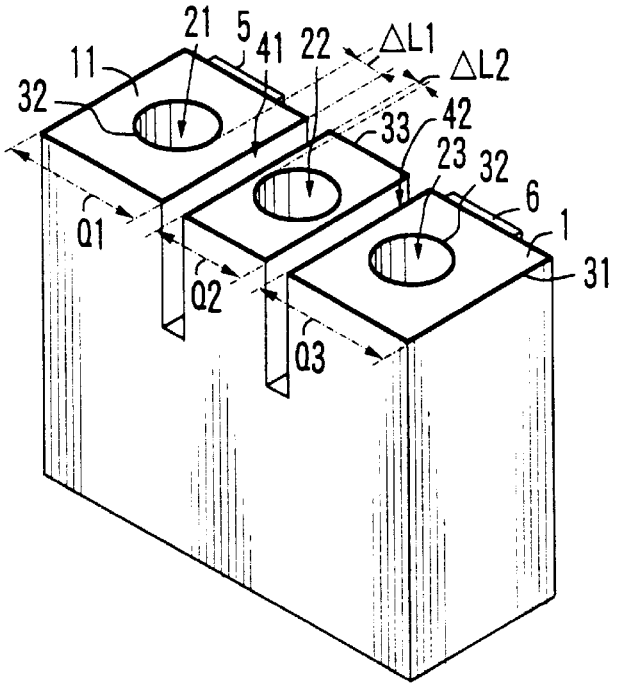
FIG. 9 is a perspective view showing yet another embodiment of the block type dielectric filter according to the present invention.

FIG. 9 is a perspective showing yet another embodiment of the dielectric filter according to the present invention. In all the embodiments shown in FIGS. 1 to 8, as a specific means for providing an offset of the grooves 41 and 42 toward either one of the through holes in the set, the grooves 41 and 42 are either bent or curved, whereas in the embodiment shown in FIG. 9, the grooves 41 and 42 are formed linearly and by controlling their positions, the grooves 41 and 42 are offset toward the through hole 22 in each set of the through holes (21, 22) and (22, 23).

For instance, to give an explanation using the groove 41 formed between the through hole 21 an the through hole 22 for an example, the groove 41 is formed with an offset while ensuring that a distance $\Delta L1$ form the internal end of the groove 41 to the through hole 21 and a distance $\Delta L2$ from the internal end of the groove 41 to the through hole 22 satisfy the relationship $\Delta L1>\Delta L2$. In this case, too, similar advantages to those achieved in the embodiments shown in FIGS. 1 to 8 are achieved.

Figure 10:
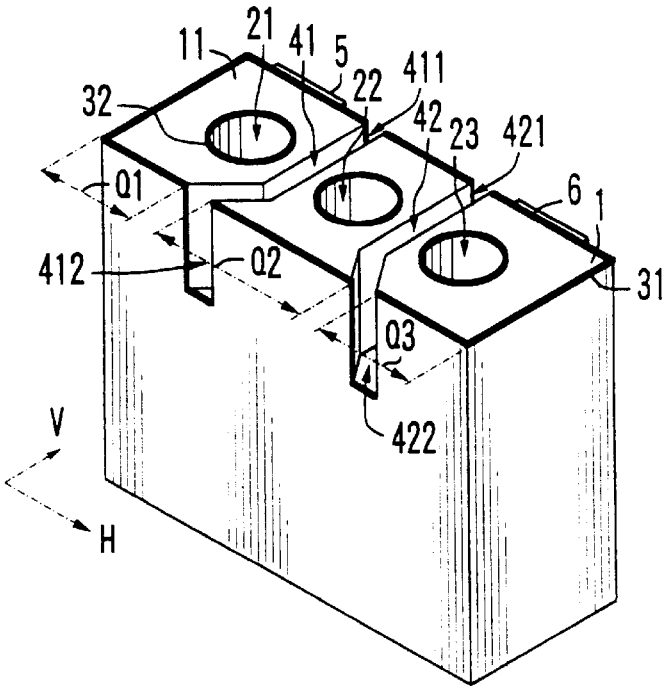
FIG. 10 is a perspective view showing yet another embodiment of the block type dielectric filter according to the present invention.

FIG. 10 is a perspective showing yet another embodiment of the dielectric filter according to the present invention. While, in the embodiments shown in FIGS. 1 to 9, the grooves 41 and 42 are clad with the conductive material layer 33, in the embodiment shown in FIG. 10, the grooves 41 and 42 are not clad with a conductive material layer. Instead, the inside surfaces of the grooves 41 and 42 are constituted with the base body surface of the dielectric block 1.

When the grooves 41 and 42 are not clad with a conductive material layer, since air with a relative dielectric constant of 1 is present in the vicinity of the open end surface 11, the essential dielectric constant of the dielectric block 1 becomes reduced. In the case of the embodiment shown in FIG. 10, the groove 41 is formed as a bent channel constituted of a perpendicular portion 411 extending in the direction V which runs approximately perpendicular to the direction H in which the through holes 21 to 23 are arranged and an inclined portion 412 which is inclined from the perpendicular portion 411 toward the through hole 21. The groove 42 is formed as a bent channel constituted of a perpendicular portion 421 extending in the direction V running approximately perpendicular to the direction H in which the through holes 21 to 23 are arranged and an inclined portion 422, which is inclined from the perpendicular portion 421 toward the through hole 23.

As mentioned earlier, since the resonance frequency f2 at the central resonating portion Q2 is lower than the resonance frequencies f1 and f3 at the resonating portion Q1 and Q3 at the two ends in a filter with three or more stages, if a structure in which the grooves 41 and 42 are not clad with a conductive material layer is to be adopted in a filter with three or more stages, the grooves 41 and 42 are provided to encompass the through holes 21 and 23 at the two ends as shown in FIG. 10. This achieves an adjustment of the resonance frequencies f1 and f3 at the through holes 21 and 23 in the direction in which they are increased.

Figure 11:
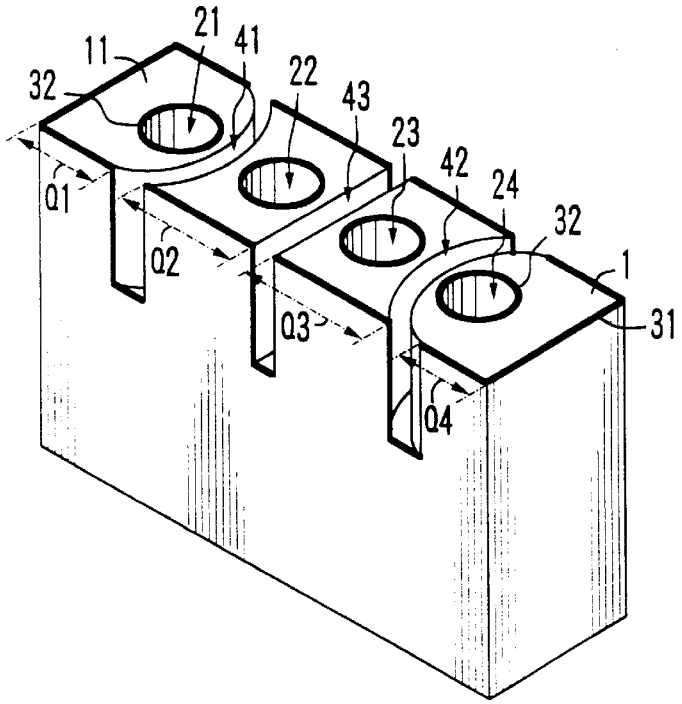
FIG. 11 is a perspective view showing yet another embodiment of the block type dielectric filter according to the present invention.

FIG. 11 is a perspective showing yet another embodiment of the dielectric filter according to the present invention. This embodiment represents an example with a structure in which the grooves 41 and 42 are not clad with a conductive material layer adopted in a four-stage filter. The grooves 41 and 42 are each formed as an arc, with the groove 41 offset toward the through hole 21 constituting the resonating portion Q1 and the groove 42 offset toward the through hole 24 constituting the resonating portion Q4. Between the through holes 22 and 23 constituting the resonating portions Q2 and Q3 respectively, a groove 43 is provided for the purpose of setting the coupling quantity.

Figure 12:
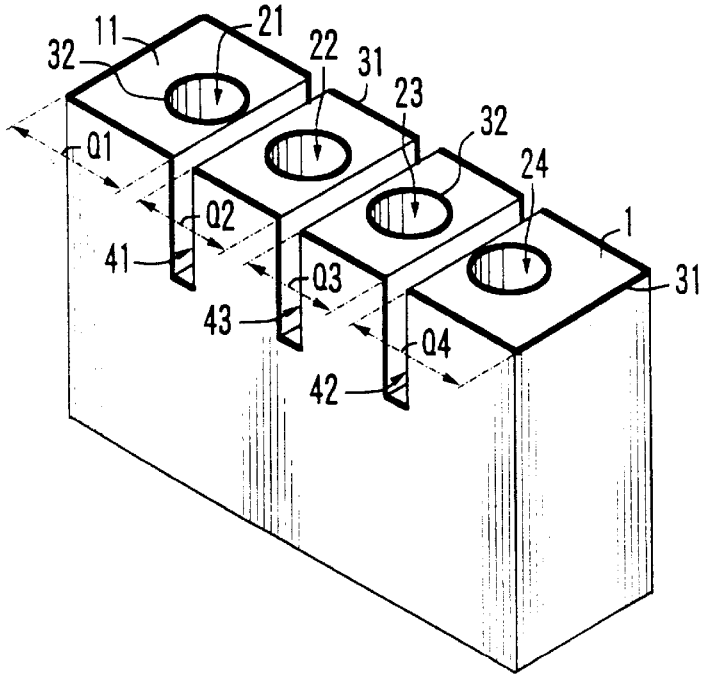
FIG. 12 is a perspective view showing yet another embodiment of the block type dielectric filter according to the present invention.

FIG. 12 is a perspective showing yet another embodiment of the dielectric filter according to the present invention. The difference between this embodiment and the embodiment shown in FIG. 11 is that in this embodiment, the grooves 41 and 42 are formed linearly. The groove 41 is offset toward the through hole 21 constituting the resonating portion Q1 whereas the groove 42 is offset toward the through hole 24 constituting the resonating portion Q4.

What is claimed is:

1. A dielectric filter comprising:

a dielectric block, including a plurality of through holes extending from one surface of said dielectric block toward a surface facing opposite said one surface, with inside surfaces of said through holes and external surfaces except for said one surface being clad with a conductive material layer; and at least one groove provided on said one surface; wherein said at least one groove is provided between at least one set of adjacent through holes;

said at least one groove has a width identical over an entire widthwise direction of said one surface;

said at least one groove has at least one portion which is offset, with respect to a line bisecting said set of adjacent through holes, toward one through hole of said set of adjacent through holes.

2. A dielectric filter according to claim 1, wherein:

said at least one groove comprises a bent channel as said offset portion.

3. A dielectric filter according to claim 2, wherein:

said bent channel includes a perpendicular portion extending in a direction perpendicular to a direction in which said plurality of through holes are arranged, and an inclined portion that is inclined from said perpendicular portion.

4. A dielectric filter according to claim 1, wherein:

said at least one groove includes a curved portion.

5. A dielectric filter according to claim 1, wherein:

said at least one groove is formed linearly so that the entire groove is said offset portion.

6. A dielectric filter according to claim 1, wherein:

inside surfaces of said at least one groove are clad with a conductive material layer continuous to said conductive material layer.

7. A dielectric filter according to claim 1, wherein:

inside surfaces of said at least one groove are formed from said dielectric block.

8. A dielectric filter according to claim 1, wherein:

said at least one groove is provided between at least one outermost through hole and an adjacent through hole to said outermost through hole among said plurality of through holes.

9. A dielectric filter according to claim 8, wherein:

said at least one groove is provided offset toward said adjacent through hole.

10. A dielectric filter according to claim 9, wherein:

said at least one groove comprises a bent channel as said offset portion.

11. A dielectric filter according to claim 10, wherein:

said bent channel includes a perpendicular portion extending in a direction perpendicular to a direction in which said plurality of through holes are arranged, and an inclined portion that is inclined form said perpendicular portion.

12. A dielectric filter according to claim 9, wherein:

said at least one groove includes a curved portion.

13. A dielectric filter according to claim 9, wherein:

said at least one groove is formed linearly so that the entire groove is said offset portion.

14. A dielectric filter according to claim 8, wherein:

said at least one groove is provided offset toward said outermost through holes.

15. A dielectric filter according to claim 14, wherein:

said at least one groove comprises a bent channel as said offset portion.

16. A dielectric filter according to claim 15, wherein:

said bent channel includes a perpendicular portion extending in a direction perpendicular to a direction in which said plurality of through holes are arranged, and an inclined portion that is inclined from said perpendicular portion.

17. A dielectric filter according to claim 14, wherein:

said at least one groove includes a curved portion.

18. A dielectric filter according to claim 14, wherein:

said at least one groove is formed linearly so that the entire groove is said offset portion.

19. A dielectric filter according to claim 1, wherein said at least one groove comprises:

first and second grooves respectively provided between at least two outermost through holes and a through hole or through holes adjacent to said two outermost through holes among said plurality of through holes.

20. A dielectric filter according to claim 19, wherein:

said first and second grooves are provided offset toward said adjacent through holes.

21. A dielectric filter according to claim 20, wherein:

said first and second grooves comprise bent channels as said offset portion.

22. A dielectric filter according to claim 21, wherein:

each of said channels includes a perpendicular portion extending in a direction perpendicular to a direction in which said plurality of through holes are arranged, and an inclined portion which is inclined from said perpendicular portion.

23. A dielectric filter according to claim 20, wherein:

each of said first and second grooves includes an arc portion.

24. A dielectric filter according to claim 20, wherein:

said first and second grooves are formed linearly so that the entire first and second grooves are said offset portion.

25. A dielectric filter according to claim 19, wherein:

said first and second grooves are provided offset toward said outermost through holes.

26. A dielectric filter according to claim 25, wherein:

said first and second grooves comprise bent channels as said offset portion.

27. A dielectric filter according to claim 26, wherein:

each of said bent channels includes a perpendicular portion extending in a direction perpendicular to a direction in which said plurality of through holes are arranged, and an inclined portion which is inclined from said perpendicular portion.

28. A dielectric filter according to claim 25, wherein:

each of said first and second grooves includes an arc portion.

29. A dielectric filter according to claim 25, wherein:

said first and second grooves are formed linearly so that the entire first and second grooves are said offset portion.

30. A dielectric filter according to claim 1, wherein:

surfaces of said at least one groove are clad with said conductive material layer.

31. A dielectric filter according to claim 1, wherein:

surfaces of said at least one groove are not clad with said conductive material layer.

* * * * *

UNITED STATES PATENT AND TRADEMARK OFFICE

CERTIFICATE OF CORRECTION

PATENT NO. : 6,246,303 B1
DATED : June 12, 2001
INVENTOR(S) : Kenji Endo

It is certified that error appears in the above-identified patent and that said Letters Patent is hereby corrected as shown below:

Title page, Item [54], and Column 1, line 1,
The Title of Invention should read:

-- [54] DIELECTRIC FILTER HAVING TUNABLE RESONATING PORTIONS --

Item [30], the Foreign Application Priority Data should read:

-- [30] Foreign Application Priority Data

Mar. 15, 1996 (JP) .....8-059656 --

Signed and Sealed this

Nineteenth Day of February, 2002

*Attest:*

*Attesting Officer*

JAMES E. ROGAN
*Director of the United States Patent and Trademark Office*